US005413502A

United States Patent [19]

Wang

[11] Patent Number: 5,413,502

[45] Date of Patent: May 9, 1995

[54] AUTO TERMINATION TYPE ELECTRICAL CONNECTOR

[76] Inventor: Tsan-Chi Wang, 1 Fl., No. 13, Lane 312, Chung Chen Rd., Hsin Tien, Taipei Hsien, Taiwan, Prov. of China

[21] Appl. No.: 189,760

[22] Filed: Feb. 1, 1994

[51] Int. Cl.[6] ..... H01R 4/54

[52] U.S. Cl. ..... 439/551; 439/314

[58] Field of Search ..... 439/620, 551, 565, 314; 333/181, 185

[56] References Cited

U.S. PATENT DOCUMENTS

| | | | |
|---|---|---|---|
| 4,202,594 | 5/1980 | Coleman et al. | 439/551 O |
| 4,660,921 | 4/1987 | Hauver | 439/620 X |
| 4,772,221 | 9/1988 | Kozlof | 439/620 X |
| 4,797,120 | 1/1989 | Ulery | 439/620 X |
| 5,032,091 | 7/1991 | Itzkoff | 439/620 O |
| 5,205,760 | 4/1993 | Agut Sanz | 439/551 O |

*Primary Examiner*—David L. Pirlot
*Assistant Examiner*—Daniel Wittels
*Attorney, Agent, or Firm*—Lowe, Price, Leblanc & Becker

[57] ABSTRACT

An auto termination type electrical connector for connecting a BNC plug to the coaxial cable of a computer network system, the connector including an auto termination circuit consisted of a ground contact plate connected to the outer conductor of the coaxial cable, a first contact metal connected to the center conductor of the coaxial cable, a second contact metal connected to the ground contact plate, a resistor element connected between the ground contact plate and the second contact metal plate, wherein when the BNC plug is connected, the first and second contact metal plates are separated from each other causing the auto termination circuit opened; when the BNC plug is removed, the first and second contact metal plates are returned to contact each other causing the auto termination circuit closed.

3 Claims, 6 Drawing Sheets

AUTO TERMINATION TYPE ELECTRICAL CONNECTOR

BACKGROUND OF THE INVENTION

The present invention relates to electrical connectors for use in computer network systems, and more particularly relates to an auto termination type electrical connector which when the BNC plug is not connected, provides an auto termination function by means of the connection of an external resistor, to protect internal signal transmission against noises.

Various capacitive coupled BNC connectors have been disclosed for connection to conductive panels or wall plates, and have appeared on the market. These capacitive coupled BNC connectors commonly comprise a BNC jack at one end for connecting a BNC plug, and a coupling portion at an opposite end for connection to the conductive panel in a computer network system. The coupling portion is a device with an electrical filter which eliminates outside noises when the BNC plug is connected to the BNC jack. The common drawback of these capacitive coupled BNC connectors is that noises may be transmitted to the electric circuit of the computer network system through the BNC jack, when the BNC plug is removed, causing transmission errors.

SUMMARY OF THE INVENTION

The present invention has been accomplished to provide a BNC type electrical connector which eliminates the common drawback of the aforesaid prior art capacitive coupled BNC connectors. This object is achieved by providing an auto termination circuit to a capacitive coupled BNC type electrical connector. The auto termination circuit is closed when the BNC plug is removed, or opened when the BNC plug is connected.

DETAILED DESCRIPTION OF THE PREFERRED EMBODIMENT

Figure 1:
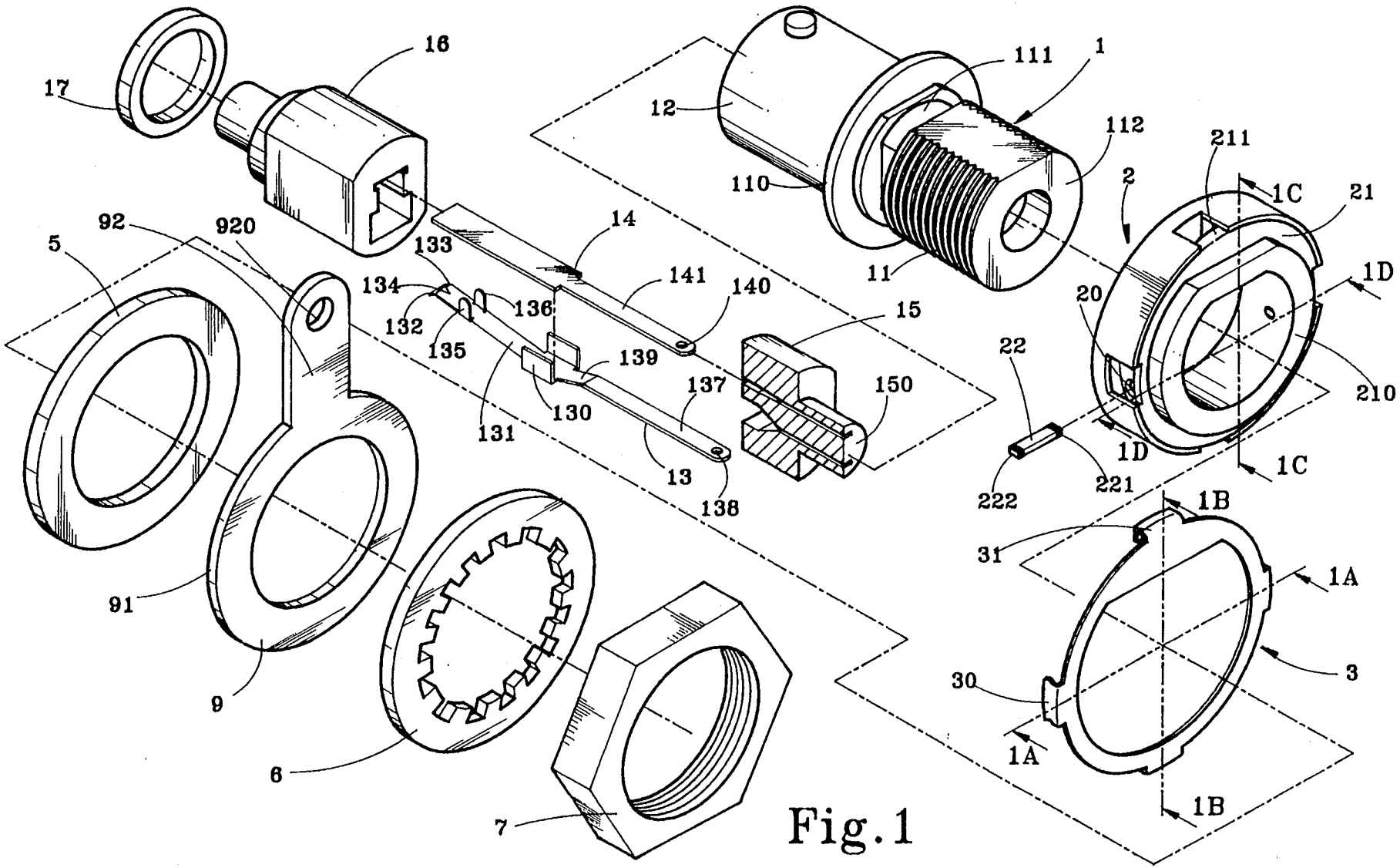
FIG. 1 is an exploded view of an auto termination type electrical connector according to the preferred embodiment of the present invention.
Figure 1B:
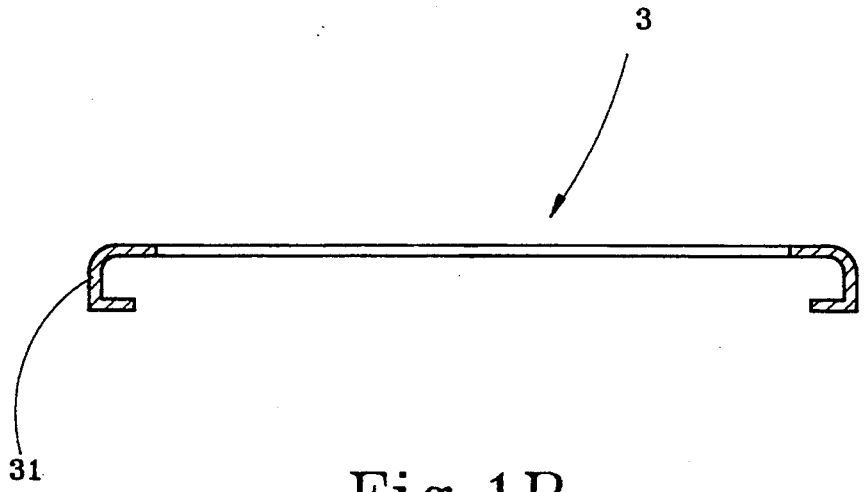
FIG. 1B is a cross section taken along line 1B—1B of FIG. 1.
Figure 1A:
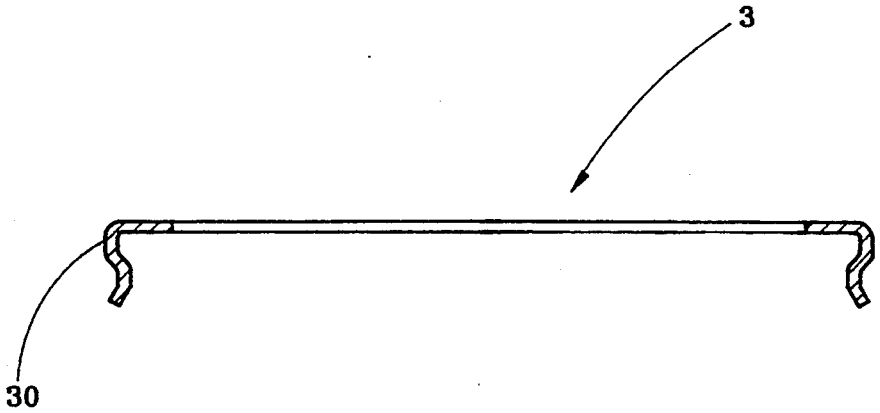
FIG. 1A is a cross section taken along line 1A—1A of FIG. 1.
Figure 1D:
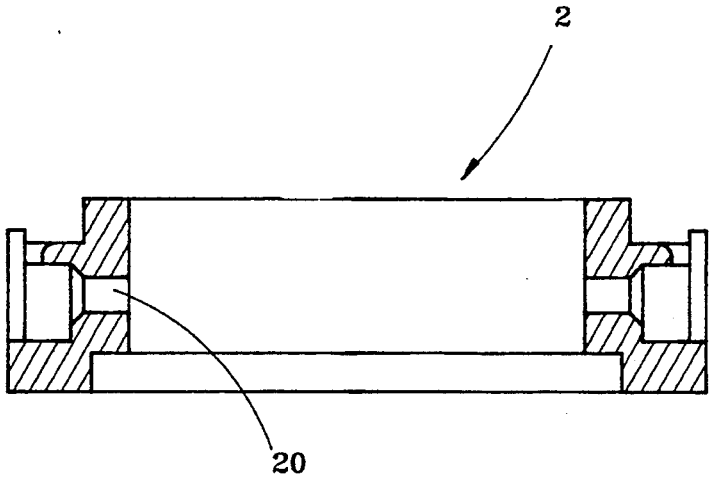
FIG. 1D is a cross section taken along line 1D—1D of FIG. 1.
Figure 1C:
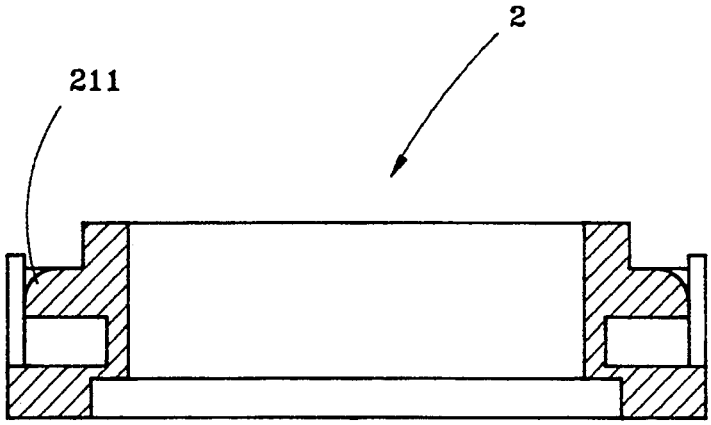
FIG. 1C is a cross section taken along line 1C—1C of FIG. 1.
Figure 3:
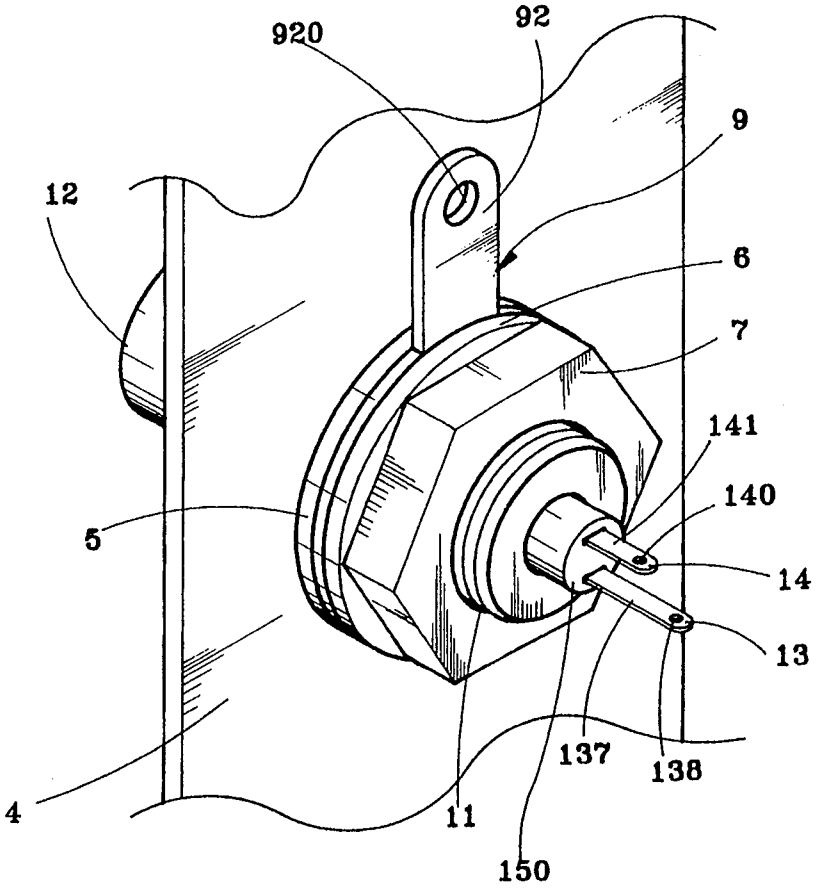
FIG. 3 shows the auto termination type electrical connector of FIG. 2 mounted on a conductive panel.
Figure 2:
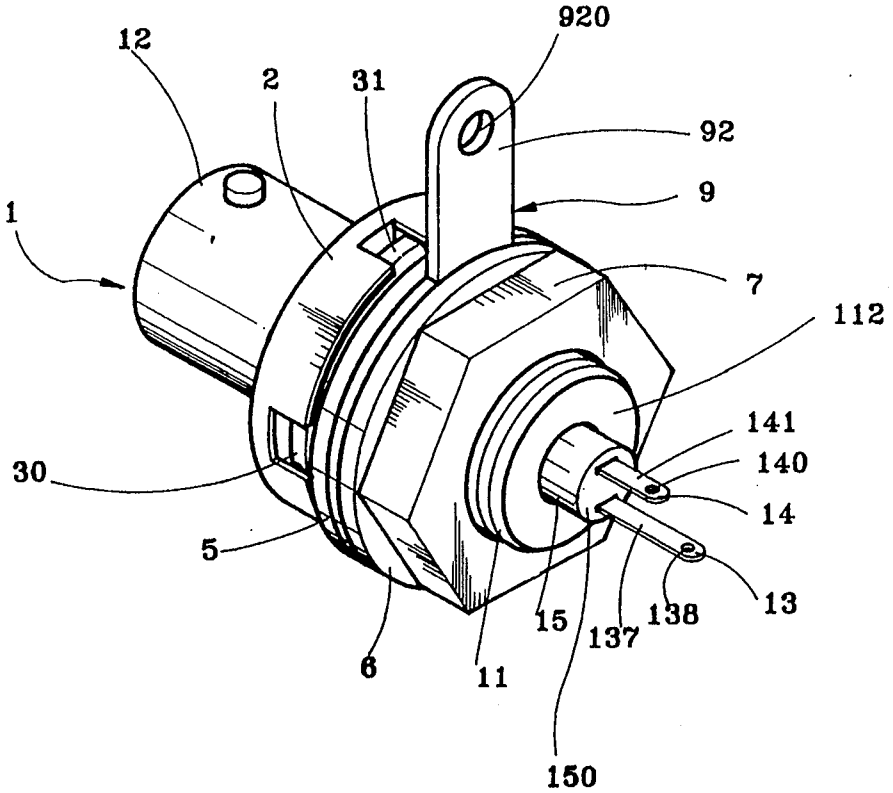
FIG. 2 is an elevational view of the auto termination type electrical connector shown in FIG. 1.

Referring to FIGS. 1, 1A, 1B, 1C, and 1D, the casing 1 of the electrical connector in accordance with the preferred embodiment of the present invention comprises an elongated outer thread portion 11 at one end, a BNC jack 12 at an opposite end, a collar 110 in the middle between the outer thread portion 11 and the BNC jack 12, and an annular groove 111 around the outside wall between the outer thread portion 11 and the collar 110. An annular insulator 2 is mounted around the annular groove 111 of the casing 1, comprising radial through holes 20 (See FIG. 1D), which receive a respective capacitor element 22, a radial projecting wall 21 at an outer side (relatively closer to the front end 112 of the outer thread portion 11 of the casing 1), and an outer annular flange 210 raised from the radial projecting wall 21 covered over part of the outer thread portion 11. The capacitor element 22 in either radial through hole 20 has one end 221 disposed in contact with the wall surface of the annular groove 111 and an opposite end 222 stopped by an elastic retainer ring 3. Therefore, the casing 1, the capacitor elements 22, and the elastic retainer ring 3 are connected together and formed into a filter circuit.

The elastic retainer ring 3 comprises a plurality of projecting strips 30 (see FIG. 1A) spaced around the border thereof and respectively inserted into a hole (not shown) on the annular insulator 2 to hold down either capacitor element 22, and a plurality of unitary hooks 31 (see FIG. 1B) respectively spaced between either two projecting strips 30 and hooked on the chamfered peripheral edge 21 (see FIG. 1C) of the radial projecting wall 21 of the annular insulator 2.

Figure 4:
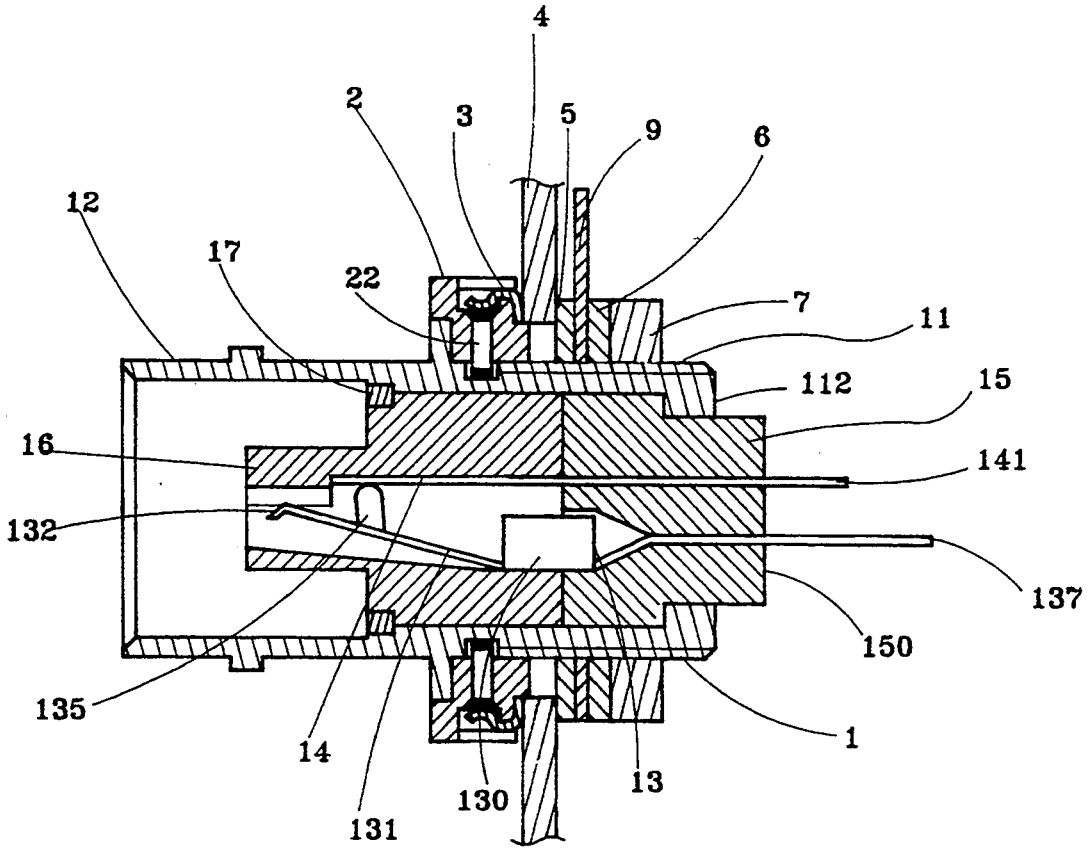
FIG. 4 is a longitudinal sectional view taken on FIG. 2.
Figure 5:
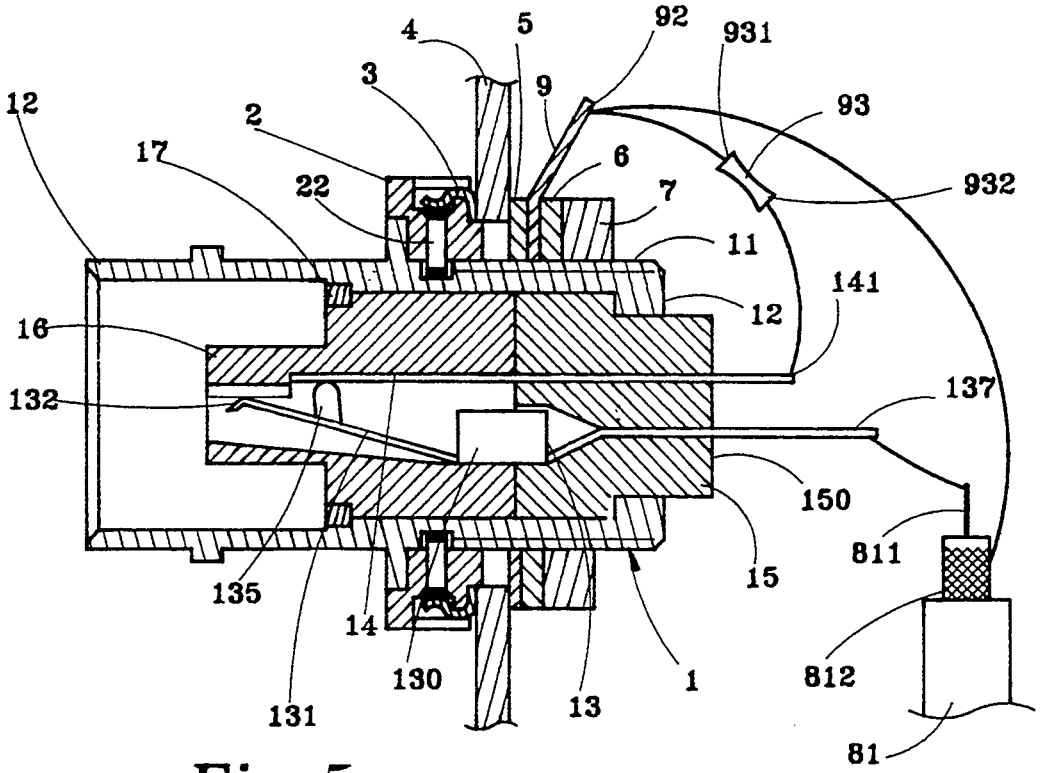
FIG. 5 is similar to FIG. 4, but showing the connect-;ion of the coaxial cable.

The aforesaid filter circuit eliminates the interference of radio waves from the panel or wall plate 4 (see FIG. 4). When the outer thread portion 11 of the casing 1 is inserted through the mounting hole (not shown) on the panel 4, an insulative ring 5, an internally toothed cushion ring 6, and a nut 7 are respectively mounted around the outer thread portion 11 of the casing 1 in proper order permitting the panel 4 to be retained between the annular insulator 2 and the insulative ring 5 and the elastic retainer ring 3 to be retained in contact with the panel 4. Therefore, noises from the panel 4 can be eliminated by the capacitor elements 22. The arrangement of the insulative ring 5 is to insulate the filter circuit so that the filtration effect of the filter circuit can be maintained effective.

Figure 6:
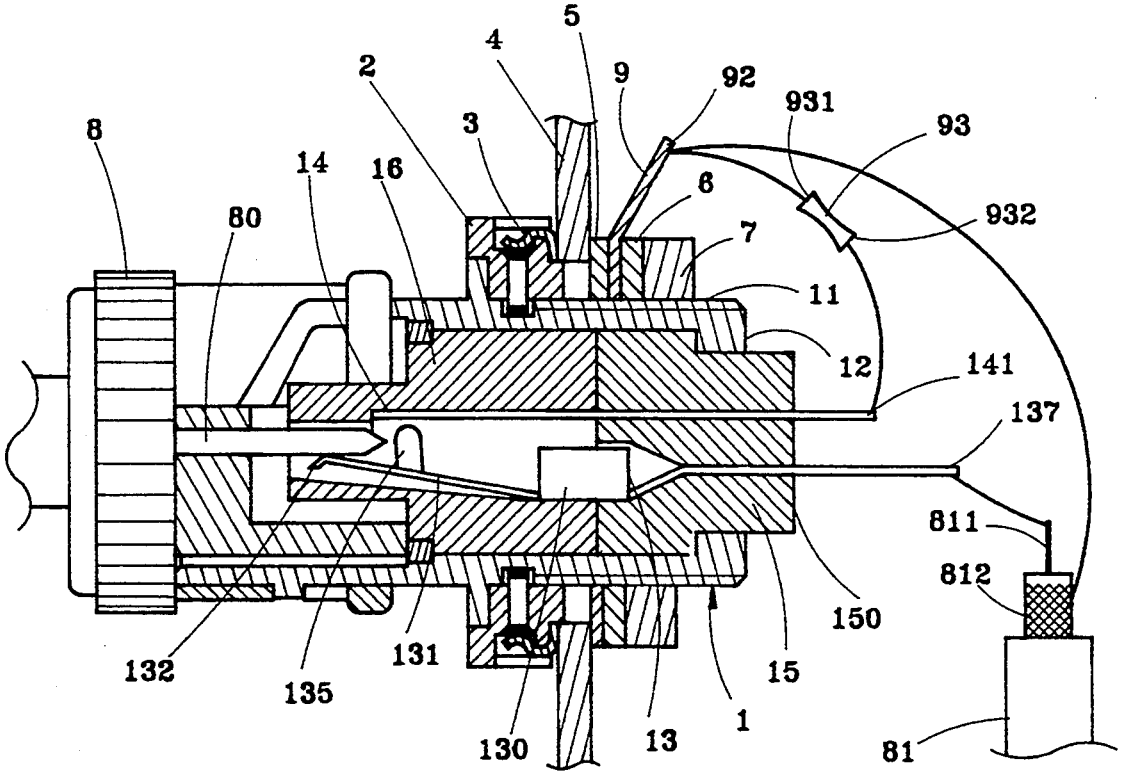
FIG. 6 is similar to FIG. 5, but showing the BNC plug connected.

Referring to FIG. 6 and FIGS. 1 and 4 again, the BNC jack 12 of the casing 1 is to receive a BNC plug 8. A first insulative socket member 15 and a second insulative socket member 16 are retained inside the casing 1 by a packing ring 17 to hold a first contact metal plate 13 and a second contact metal plate 14 axially on the inside at different elevations. The first insulative socket member 15 has a front end 150 extended out of the front end 112 of the outer thread portion 11 of the casing 1. The second contact metal plate 14 has a hole 140 on the front end 141 thereof extended outside the front end of the first insulative socket member 15. The first metal plate 13 comprises a middle mounting portion 130 engaging to the first insulative socket member 15, a front extension 137 extended from the middle mounting portion 130 in one direction and having a hole 138 disposed outside the front end 150 of the first insulative socket member 15, a front bevel portion 139 connected between the middle mounting portion 130 and the front extension 137 and supported on a sloping surface inside the first insulative socket member 15, a rear extension 131 obliquely extended upward from the middle mounting portion 130 in the reversed direction and terminating in a downward sloping guide tail 132, an arched section 134 at the turning point 133 between the rear extension 131 and the downward sloping guide tail 132, and two upward contact legs 135;136 extended from the rear extension 131 and disposed between the middle mounting portion 130 and the sloping guide tail 132. When the BNC plug 8 is connected, the contact legs 135;136 of the first contact metal plate 13 are respectively disposed in contact with the second contact metal plate 14. When the BNC plug 8 is inserted into the BNC jack 12 of the casing 1, the center contact 80 of the BNC plug 8 will be guided into position by the sloping guide tail 132 and disposed in contact with the arched section 134.

Referring to FIGS. 1, 2, 4 and 5 again, there is provided a ground contact plate 9 comprising a mounting ring 91 mounted around the outer thread portion 11 of the casing 1 and retained between the insulative ring 5 and the internally toothed cushion ring 6, and a lug 92 extended from the mounting ring 91. The lug 92 has a through hole 920 (see FIG. 1) to hold a resistor element 93. The resistor element 93 has one end 931 connected to the lug 92 and an opposite end 932 connected to the front end 141 of the second contact metal plate 14. Therefore, the first contact metal plate 13, the second contact metal plate 14, the resistor element 93, and the ground contact plate 9 are connected together, when the BNC plug 8 is not connected, and formed into an auto termination circuit. When mounted, the front extension 137 of the first contact metal plate 13 is connected to the center conductor 811 of the coaxial cable 81, and the outside conductor 812 of the coaxial cable 81 is connected to the lug 92 of the ground contact plate 9. Therefore, the electrical connector can effectively eliminate noises from interfering with the transmission of the coaxial cable 81. Furthermore, the aforesaid holes 138;140 on the first and second contact metal plates 13;14 are for fastening the coaxial cable 81 and the resistor element 93 conveniently.

Referring to FIG. 6 again, when the BNC plug 8 is fastened to the BNC jack 12 of the casing 1, the rear extension 131 of the first contact metal plate 13 will be forced down by the center contact 80, causing the contact legs 135;136 to move away from the second contact metal plate 14, and therefore the auto termination will be automatically released when the BNC plug 8 is connected.

While only one embodiment of the present invention has been shown and described, it will be understood that various modifications and changes could be made without departing from the spirit and scope of the invention.

I claim:

1. An electrical connector comprising a casing having an outer thread portion at one end fastened to a metal panel of a computer network system by an annular insulator, an insulative ring, an internally toothed cushion ring, and a nut, and a BNC jack at an opposite end for connecting a BNC plug; and an auto termination circuit, wherein said auto termination circuit comprises:

a ground contact plate mounted around said outer thread portion and retained between said insulative ring and said internally toothed cushion ring, and having a lug projecting radially outward;

a first contact metal plate horizontally fastened in a first insulative socket member and a second insulative socket member inside said casting for connecting to the center conductor of a coaxial cable of the computer network system, said first contact metal plate having a front end extended out of said first insulative socket member and said casing and a rear end disposed in a center hole in said second insulative socket member;

a second contact metal plate horizontally fastened in said first and second insulative socket members and spaced from said first contact metal plate for connecting to the outer conductor of the coaxial cable of said computer network system, said second contact metal plate having a front end extended out of said first insulative socket member and said casing and a rear end disposed in the center hole in said second insulative socket member; and a resistor element having one end connected to said lug of said ground contact plate and an opposite end connected to said second contact metal plate.

2. The electrical connector of claim 1 wherein said lug of said ground contact plate has at least one through hole for mounting said resistor element.

3. The electrical connector of claim 1 wherein said first and second contact metal plates each have a through hole in the front end for respectively connecting the center conductor of the coaxial cable to the first contact metal plate, or said resistor element to the second contact metal plate.

* * * * *